United States Patent [19]

Roman

[11] Patent Number: 4,515,133

[45] Date of Patent: May 7, 1985

[54] FUEL ECONOMIZING DEVICE

[76] Inventor: Frank Roman, Star Rte. 113, Long Pond, Pa. 18334

[21] Appl. No.: 615,581

[22] Filed: May 31, 1984

[51] Int. Cl.[3] ..... F23D 21/00

[52] U.S. Cl. ..... 123/538; 123/557; 210/446

[58] Field of Search ..... 123/538, 590, 557; 210/172, 232, 446, 137, 416.4

[56] References Cited

U.S. PATENT DOCUMENTS

| | | | |
|---|---|---|---|
| 2,288,715 | 7/1942 | Karrer | 210/137 |
| 2,545,789 | 3/1951 | Miller | 210/137 |
| 2,901,112 | 8/1959 | Naftulin | 210/446 |
| 3,597,668 | 8/1971 | Yoshimine | 123/538 |
| 3,633,752 | 1/1972 | Kurpgeweit | 210/232 |
| 4,422,429 | 12/1983 | Reed | 123/538 |

FOREIGN PATENT DOCUMENTS

| | | | |
|---|---|---|---|
| 1158634 | 6/1958 | France | 210/446 |
| 1178372 | 5/1959 | France | 210/446 |

*Primary Examiner*—Ronald H. Lazarus
*Attorney, Agent, or Firm*—Ruth Moyerman

[57] ABSTRACT

An internal combustion engine fuel economizing device is disclosed. A cylinder having an inlet and an outlet is installed between the fuel pump and the carburetor. Fuel discharged from the fuel pump enters the cylinder inlet through an inlet conduit. The fuel stream is filtered by a filtering device located within the inlet conduit. The fuel is concentrated in the cylinder by the fuel pump pressure, and exits the cylinder through an outlet conduit. At the terminus of the outlet conduit is a restricted opening which creates a pressure drop. The pressure drop changes the fuel stream to a liquid-vapor phase which enters the carburetor for mixing with air prior to combustion in the engine.

4 Claims, 5 Drawing Figures

FUEL ECONOMIZING DEVICE

BACKGROUND OF THE INVENTION

1. Field of the Invention

This invention relates to internal combustion engines, and more particularly to charge forming.

2. Description of the Prior Art

In recent years, a major problem of the automobile industry is the need to make engines more fuel efficient due to the increasing cost of fuel and legislation requiring maximum miles per gallon engine combustion efficiency. Many devices have been developed and improved including electronic solid state ignition systems, fuel injection systems and turbo chargers, to name a few. Those devices, however, are complex systems requiring specially trained technicians and highly technical diagnostic instruments to maintain the device's fuel economizing efficiency. There currently isn't a device which is easily retrofitted to and maintained in existing engines and integrated into newly manufactured engines.

SUMMARY OF THE INVENTION

The aforementioned prior art problems are overcome by the fuel economizing device of this invention. The device consists of a chamber having an inlet conduit at one end and an outlet conduit at the opposite end. The device is located in the fuel system between the fuel pump and the engine carburetor. Fuel discharged from the fuel pump enters the inlet conduit. A filtering device, i.e. fine mesh screen, located in the conduit, removes any particulate matter from the fuel stream.

The fuel passes into the chamber where it is concentrated due to the pressure build-up in the chamber exerted by the fuel pump. The fuel is discharged from the chamber through the restricted opening of the outlet conduit. Due to the pressure drop across the restricted opening, the fuel is atomized into a liquid-vapor state prior to entering the carburetor fuel inlet. The preconditioning of the fuel by the device, prior to entering the carburetor, enhances the air/fuel mixing in the carburetor, thereby making the engine more efficient when combusting the fuel. Field tests have indicated increased combustion efficiency of up to 25%.

It is therefore an object of this invention to provide a fuel economizing device which may be retrofitted to existing engines as well as integrated into newly manufactured engines.

It is another object of this invention to provide a fuel economizing device which is easy to install and maintain.

It is yet another object of this invention to provide a fuel economizing device which increases the engine conbustion efficiency up to 25%.

These and other objects will be more readily ascertainable to one skilled in the art by reference to the accompanying drawing and exemplary embodiments that follow.

BRIEF DESCRIPTION OF THE DRAWING(S)

DETAILED DESCRIPTION OF THE PREFERRED EMBODIMENT(S)

Figure 1:
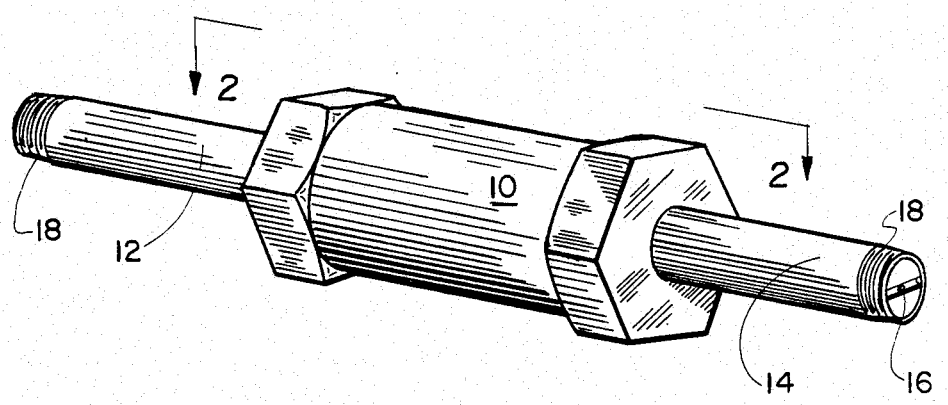
FIG. 1 is an elevation of the invention showing the device in use.

Referring now to FIG. 1, cylinder 10 is shown having inlet conduit 12 mated to cylinder 10 at one end, and outlet conduit 14 mated to cylinder 10 at the opposite end. At the terminus of outlet conduit 14 is restricted opening 16. In use, threaded surfaces 18 provide a means of mating inlet conduit 12 and outlet conduit 14 to cylinder 10 at one end and to the engine fuel line at the other end.

Figure 2:
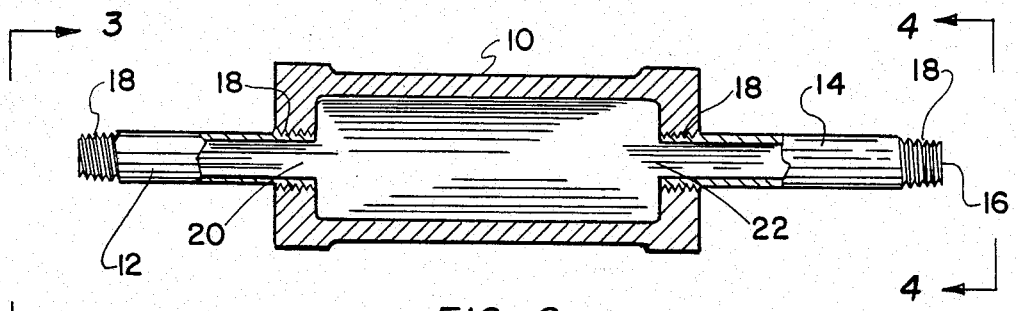
FIG. 2 is a longitudinal cross section of the invention taken along lines 2—2 of FIG. 1 showing the chamber and its inlets and outlets.

Referring now to FIG. 2, cylinder 10 is shown in longitudinal cross section with inlet 20 at one end and outlet 22 at the opposite end. Inlet conduit 12 is mated to cylinder 10 through inlet 20 and secured in place by threaded surface 18. Outlet conduit 14 is mated to cylinder 10 through outlet 22 and secured in place by threaded surfaces 18. In use, threaded surfaces 18 at the terminus of inlet conduit 12 and outlet conduit 14 provide a means of mating the device to the engine fuel line. Fuel flows through inlet conduit 12 and inlet 20 into cylinder 10 where the fuel pressure is inceased, after which the fuel exits through outlet 22 and outlet conduit 14 and restricted opening 16.

Figure 3:
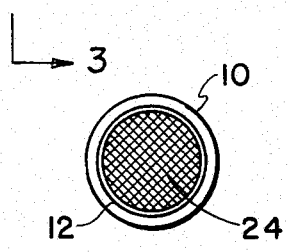
FIG. 3 is a cross section taken along lines 3—3 of FIG. 2 showing the fuel filter.

Referring now to FIG. 3, an end view of the inlet is shown including filtering device 24, i.e. a fine mesh screen, transversely mounted across inlet conduit 12. In use, filtering device 24 provides a means to remove particulate matter from the fuel stream prior to entering cylinder 10.

Figure 4:
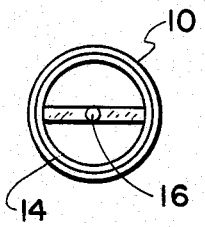
FIG. 4 is a cross section taken on lines 4—4 of FIG. 2 showing the restricted opening.

Referring now to FIG. 4, restricted opening 16 is mounted at the terminus of outlet conduit 14. In use, fuel travels from cylinder 10 through outlet conduit 14, exiting through restricted opening 16, and undergoes a change from a liquid to a liquid-vapor phase mixture due to the pressure drop across restricted opening 16.

Figure 5:
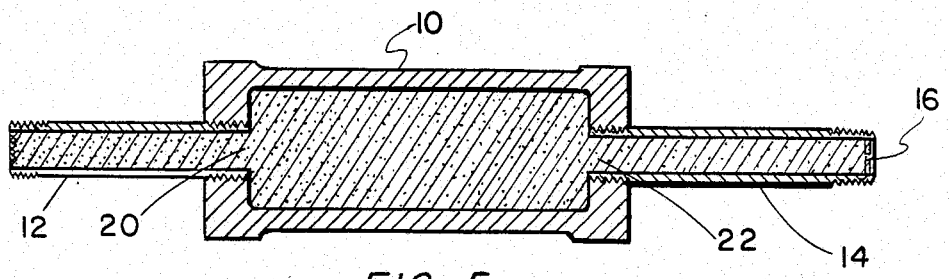
FIG. 5 is a longitudinal cross section taken on lines 2—2 of FIG. 1 schematically illustrating the pressure changes of the fuel stream as it flows through the device.

Referring now to FIG. 5, the fuel stream enters inlet conduit 12 under pressure of the engine fuel pump. The fuel flows through inlet conduit 12 and enters cylinder 10 through inlet 20. As more fuel enters cylinder 10, the fuel pressure increases and forces some of the fuel to exit via outlet 22. The fuel moves through outlet conduit 14 and through restricted opening 16 where the pressure drop across restricted opening 16 changes the fuel stream to a liquid-vapor phase. This vaporized mixture provides highly efficient mixing of air and fuel when the fuel stream enters the carburetor inlet.

Empirical observations of the device in use have determined optimal efficiency is attained when cylinder 10 has an internal diameter of 0.75 inches and a length of 2.25 inches. Restricted opening 16 must have a diameter of not less than 0.045 inches and not more than 0.050 inches to achieve optimal efficiency from the device.

There are many variations which may be practiced within the scope of this invention. For example, cylinder 10, inlet conduit 12 and outlet conduit 14 may be fabricated as an integrated unit obviating the need for threaded surfaces 18 to secure inlet conduit 12 and outlet conduit 14 to inlet 20 and outlet 22.

Although the prototype of this device was constructed from brass materials and this was satisfactory, other materials such as high density plastics or aluminum could be utilized.

Yet another variation within the scope of this invention is fabrication of filtering device 24 from materials other than metal screening. Alternate configurations could include sedimentation bowls.

The device of this invention has many advantages. Chiefly among these is the simple construction of the device which makes it inexpensive to manufacture and easy to use.

Secondly, the device may be easily retrofitted to an existing engine or easily designed into a newly manufactured engine.

Thirdly, field tests have shown the device increases the fuel combustion efficiency of the engine significantly.

Having now described and illustrated my invention, it is not intended that such description limit the scope of this invention, but rather that this invention be limited only by a reasonable interpretation of the appended claims.

What is claimed is:

1. A fuel economizing device for internal combustion engines comprising:

(a) a cylinder having generally a length of about 2.25 inch and a diameter of about 0.75 inch, said cylinder also having an inlet at one end and an outlet at the opposite end;

(b) a conduit, said conduit mated at its one end to said cylinder inlet, said conduit opposite end being adapted to connect to a fuel pump outlet line;

(c) a second conduit, said second conduit mated at its one end to said cylinder outlet, said conduit opposite end being adapted to connect to a carburetor fuel inlet line; and, (d) a restricted opening, said restricted opening positioned at the terminus of said second conduit's opposite end, said restricted opening having a diameter ranging from about 0.045 inch to about 0.050 inch, so that fuel passing through said inlet conduit under pressure from a fuel pump, enters said cylinder where said fuel is concentrated under pressure, and exits through said restricted opening causing said fuel to atomize into a combination of liquid and vapor state due to the pressure drop across said restricted opening.

2. The device according to claim 1 including, additionally, a filtering device mounted transverse said inlet conduit, said filtering device being a fine mesh screen, so that fuel is filtered before it enters said cylinder.

3. The device according to claim 1 wherein said inlet conduit and said outlet conduit are mated to said cylinder by threaded surfaces.

4. A method to economize on fuel usage with an internal combustion engine, said method comprising:

(a) passing said fuel into a fuel pump;

(b) pumping said fuel from said pump into an inlet conduit of a fuel economizing device;

(c) passing said fuel from said inlet conduit to a cylinder where said fuel is concentrated under pressure; said cylinder having generally a length of about 2.25 inches and a diameter of about 0.75 inch;

(d) releasing said concentrated fuel from said cylinder through a restricted opening in an outlet conduit, said restricted opening having a diameter ranging from 0.045 inch to 0.050 inch, said fuel thereby atomizing into a combination of liquid and vapor due to a pressure drop across said restricted opening; and, (e) passing said atomizing fuel into said carburetor for mixing with air prior to combustion.

* * * * *